United States Patent [19]

Larson

[11] Patent Number: 4,883,016

[45] Date of Patent: Nov. 28, 1989

[54] COLLAPSIBLE MARINE PRIVACY CHAMBER

[76] Inventor: Thomas A. Larson, 1217 Phelps St., Red Wing, Minn. 55066

[21] Appl. No.: 196,981

[22] Filed: May 20, 1988

[51] Int. Cl.[4] ..... B63B 17/00

[52] U.S. Cl. ..... 114/363; 114/364; 4/599

[58] Field of Search ..... 4/599, 460, 476; 135/95, 106, 116, 901, 902, 904; 114/343, 363, 364

[56] References Cited

U.S. PATENT DOCUMENTS

| | | | |
|---|---|---|---|
| 245,833 | 8/1881 | Imse | 4/476 |
| 689,164 | 12/1901 | Castle | 4/599 |
| 997,270 | 7/1911 | Cofrode | 4/460 |
| 1,575,131 | 3/1926 | Schumacher | 4/460 |
| 2,957,183 | 10/1960 | Nagel et al. | 4/476 |
| 3,293,664 | 12/1966 | Coons | 4/603 |
| 3,646,618 | 3/1972 | Johnson | 4/147 |
| 4,413,363 | 11/1983 | Troiano | 4/599 |
| 4,453,280 | 6/1984 | Greenleaf | 4/599 |
| 4,539,720 | 9/1985 | Westerweller | 4/599 |
| 4,569,301 | 2/1986 | Pyburn | 114/364 X |

FOREIGN PATENT DOCUMENTS

| | | | |
|---|---|---|---|
| 1490807 | 8/1967 | France | 135/902 |

OTHER PUBLICATIONS

Thetford Porta Potti® 135 Brochure (Published on a date unknown, prior to Feb. 1, 1988).

Bass Pro Shops® Sales Catalog, p. 103 (Bass Pro Shops®, copyright 1987).

Sears Annual Home and Hardware, Auto and Leisure Catalog Segment, p. 289A (Sears & Co., copyright 1988).

*Primary Examiner*—Sherman D. Basinger

*Attorney, Agent, or Firm*—Merchant, Gould, Smith, Edell, Welter & Schmidt

[57] ABSTRACT

A collapsible privacy chamber preferably for use aboard a boat or other watercraft is provided. The privacy chamber includes an openable enclosure having an openable top, a sectional support member, mechanism for anchoring the sectional support member inside of the openable enclosure, an upper suppport frame, a flexible sheet attachable to the upper support frame such that the flexible sheet can hang from the upper support frame thereby providing a partial enclosure such that one can obtain a measure of privacy inside of the partial enclosure, an upper mechanism for supporting the upper support frame such that the upper support frame can support the flexible sheet. The sectional support member preferably includes a plurality of elongated cooperating segments. The sectional support member cooperates with the anchoring mechanism to anchor the support member in the openable enclosure such that the assembled support member can extend vertically from the enclosure. Preferably, the privacy chamber includes a portable toilet located inside the openable enclosure. The elements of the partial enclosure are preferably collapsible such that they may be disassembled and placed within the openable enclosure so that the openable enclosure may be closed and used as a bench on the deck of a watercraft. The openable enclosure is preferably portable, however, in an alternate embodiment, it is incorporated into the deck of a boat.

18 Claims, 2 Drawing Sheets

FIG. 5
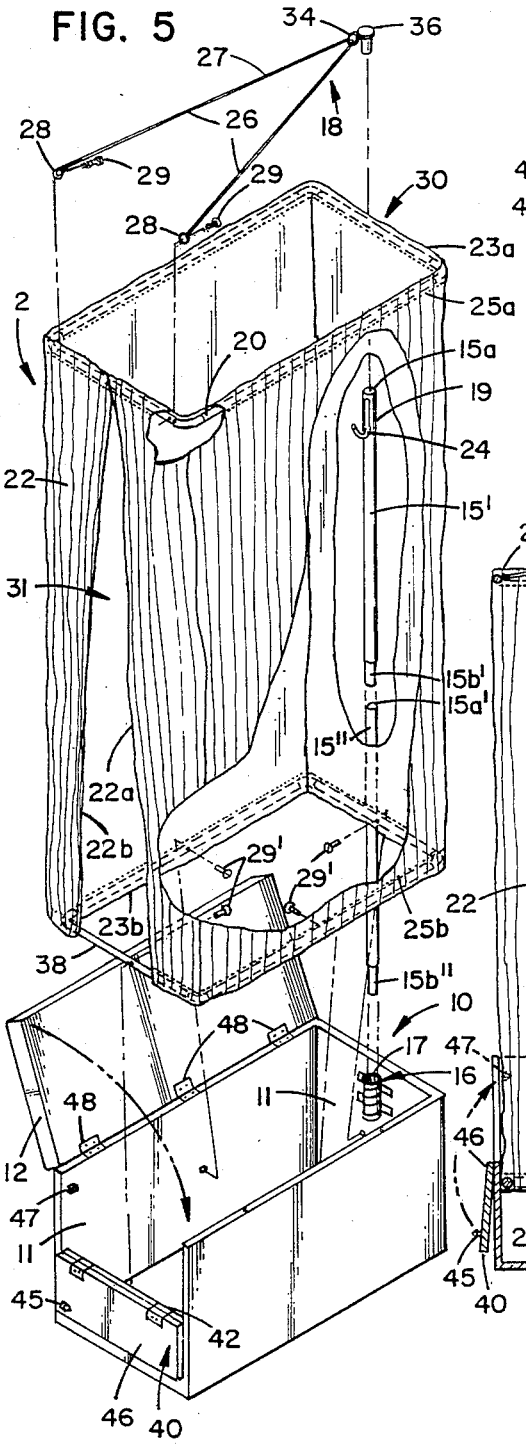
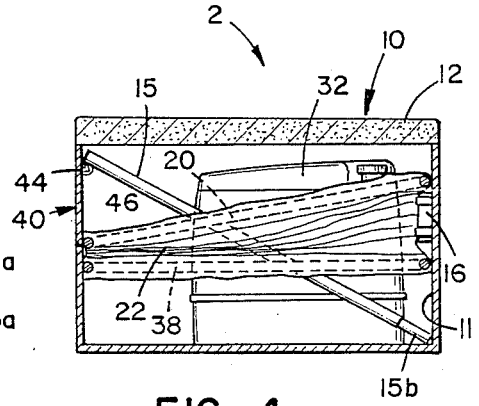
FIG. 4
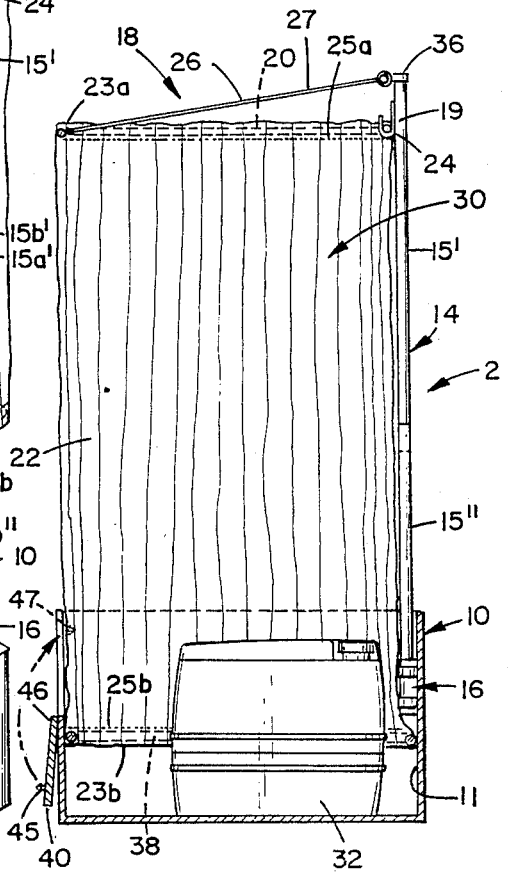
FIG. 6

COLLAPSIBLE MARINE PRIVACY CHAMBER

FIELD OF THE INVENTION

The present invention relates to a collapsible privacy chamber preferably for use aboard a boat or other watercraft.

BACKGROUND OF THE INVENTION

Water recreation has flourished in the past twenty years. An increasing number of individuals own watercraft of various types and enjoy significant periods of time recreating or relaxating on inland lakes and waterways. Many of these watercraft are not large enough to include a toilet or other privacy chamber for changing clothes or using toilet facilities on board the watercraft and out of view of individuals on shore or in other boats or watercraft. Therefore, a need exists for privacy chambers on board smaller watercraft so that individuals can change clothes or use toilet facilities on board the craft without disembarking to do so.

The present invention addresses these and other problems associated with recreational use of watercraft by individuals spending significant periods of time thereon. The present invention also offers other advantages over the prior art, and solves other problems associated therewith.

SUMMARY OF THE INVENTION

In accordance with the present invention, a privacy chamber is provided. The privacy chamber comprises an openable enclosure having an openable top, a sectional support member, means for anchoring said sectional support member inside of said enclosure, an upper support frame attachable to an upper portion of said support member, a flexible sheet attachable to the upper support frame such that the flexible sheet can hang from the upper support frame thereby providing a partial enclosure such that one can obtain a measure of privacy inside of said partial enclosure, and upper support means for supporting the upper support frame such that the upper support frame can support the flexible sheet when the sheet is attached to the upper support frame. The sectional support member preferably includes a plurality of elongated cooperating segments. The cooperating segments can be assembled together to form the sectional support member. The anchoring means cooperate with the cooperating segments such that the cooperating segments can be assembled with the anchoring means so that the assembled support member extends vertically from the enclosure. Preferably, the privacy chamber includes a portable toilet located inside the openable enclosure. In the most preferred embodiment, the elements of the partial enclosure are collapsible such that they may be disassembled and placed within the openable enclosure, preferably including the portable toilet, so that the openable enclosure may be closed and used as a bench on the deck of a watercraft.

The preferred embodiment of the present invention does not take up very much space on the deck of a boat or other watercraft. The most preferred dimensions of the openable enclosure of the invention are about 19 inches×19 inches×32 inches (about 48 cm×48 cm×81 cm). Furthermore, it is preferably portable and can be moved from place to place on a deck when the need for space varies. The openable enclosure preferably includes a padded bench top which provides seating for individuals sitting on the deck of the boat. In an alternate embodiment, the openable enclosure may be incorporated into the deck of the boat. In either case, the openable enclosure does not take up a large amount of space, and is therefore appropriate for use on smaller watercraft intended for recreational use upon inland lakes and waterways. Because the preferred openable enclosures containing portable toilets do not take up a large amount of space, the present invention has advantages over bathrooms and the like found on larger watercraft. It will be appreciated that, due to the smaller size of many of the watercraft used on inland lakes and waterways, many of the prior art solutions to this problem would be unacceptable.

The present invention also provides for an extremely rapid assembly which enables the user to use the privacy chamber at a moment's notice for whatever function may be required. The present privacy chamber may be assembled by opening the openable enclosure, assembling the sectional support member and anchoring it inside the enclosure, taking the upper support frame and attached flexible sheet out of the enclosure and attaching the same to the upper portion of the sectional support member. Once the sectional support member is assembled and in place, it can support the upper support frame and the flexible sheet, thereby allowing a very rapid assembly of the privacy chamber. The privacy chamber may then be used immediately, thereby minimizing any delay in its use while the privacy chamber is assembled.

Furthermore, the present invention preferably provides a portable privacy chamber which can be moved from place to place on a watercraft or removed to shore or to another watercraft if desired. Preferably, the portable toilet of the preferred embodiment may be removed from the openable enclosure and subsequently returned after it has been emptied, cleaned or used elsewhere.

The above described features and advantages, along with various other advantages and features of novelty are pointed out with particularity in the claims of the present application. However, for a better understanding of the invention, its advantages, and objects obtained by its use, references should be made to the drawings which form a further part of the present application and to the accompanying descriptive matter in which there is illustrated and described preferred embodiments of the invention.

BRIEF DESCRIPTION OF THE DRAWINGS

In the drawings, in which like and primed reference numerals and letters indicate corresponding parts of the preferred embodiment of the present invention throughout the several views;

FIG. 4 is a sectional side view of a disassembled portable privacy chamber in accordance with the present invention including a portable toilet located inside the openable enclosure;

FIG. 5 is an exploded perspective view of a fully assembled portable privacy chamber in accordance with the present invention similar to that shown on the deck of the watercraft shown in FIGS. 1 and 2; and FIG. 6 is a sectional side view of an assembled privacy chamber in accordance with the present invention including a portable toilet within the openable enclosure.

DETAILED DESCRIPTION OF THE PREFERRED EMBODIMENTS

Figure 1:
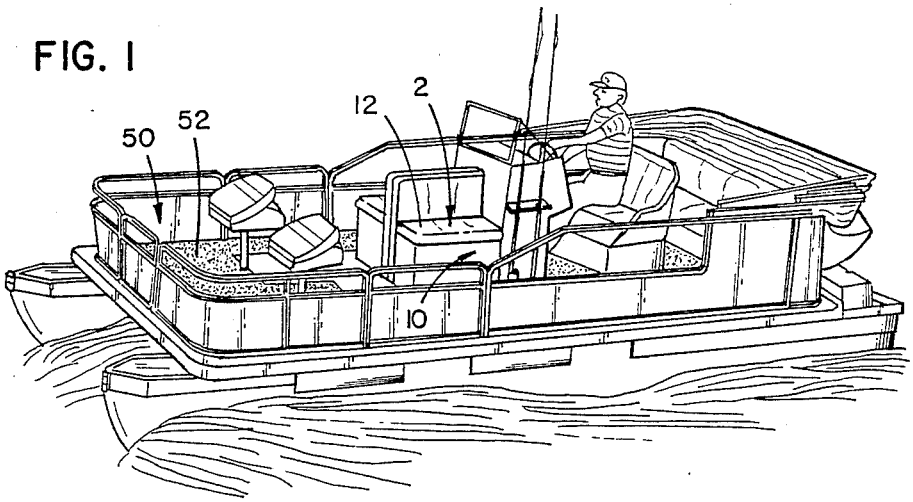
FIG. 1 is a perspective view of a watercraft having a disassembled privacy chamber in accordance with the present invention on its deck.
Figure 2:
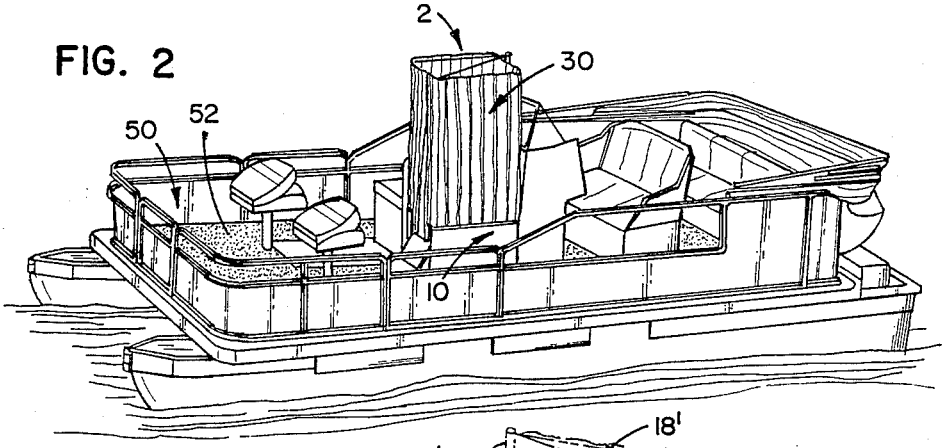
FIG. 2 is a perspective view of the watercraft shown in FIG. 1 wherein the privacy chamber shown in FIG. 1 is assembled.

Referring now to the drawings, and initially to FIGS. 1 and 2, the present invention provides a privacy chamber 2 comprising an openable enclosure 10 having an openable top 12. Parts of the privacy chamber 2 are collapsible and may be stored within the openable enclosure 10. Preferably, the openable enclosure 10 is a free standing unit which is portable. The free standing openable enclosure 10 of the present invention may be moved from place to place, including being placed in various positions on the deck 52 of a watercraft 50 such as it is shown in FIGS. 1 and 2. Because the openable enclosure 10 is portable, it can be moved from one watercraft 50 to another, or it may be removed from the watercraft 50 entirely and stored in a suitable storage space, such as the owner's garage or basement, and returned to the watercraft 50 when the watercraft 50 is being used for recreational or other purposes.

The privacy chamber 2 is particularly useful on the deck 52 of a watercraft 50, such as the pontoon boat shown in FIGS. 1 and 2. Such boats generally have limited deckspace and no cabin space. Therefore, the space which is provided must be carefully used and conserved. Because the privacy chamber 2 of the present invention uses relatively little space, and provides alternate functions, it is particularly useful on such watercraft 50. It takes up very little space and can be moved from place to place or removed. It can be used as a bench to provide seating space when disassembled, and can be very rapidly assembled to provide a partial enclosure 30 so that individuals on the watercraft 50 may obtain a measure of privacy when they wish to change into other clothes or recreational attire, or use the toilet facilities which are provided by the preferred embodiment.

Figure 3:
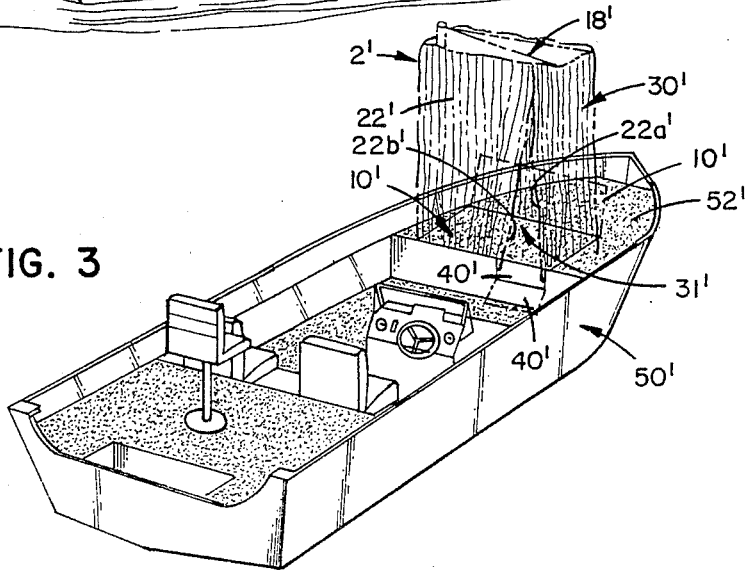
FIG. 3 is a perspective view of a bass boat including a privacy chamber in accordance with the present invention having an openable enclosure incorporated within the deck of the bass boat wherein the openable enclosure is shown open with an assembled privacy chamber in phantom.

Referring now also to FIG. 3, an alternate embodiment of the present invention is also provided which is incorporated into the deck 52' of a bass boat 50'. This embodiment of the privacy chamber 2' is not portable, however, it efficiently utilizes a small amount of otherwise unusable space below the deck 52' of the bass boat 50', thereby conserving space on the deck 52' of the boat 50'. Such boats 50' are generally considered to be far too small to accommodate a bathroom or any other enclosed space which would afford an individual on the boat 50' a degree of privacy for either changing clothes or using toilet facilities.

When the parts of the privacy chamber 2 of the present invention have been assembled, they provide a partial enclosure 30 within which one can obtain a measure of privacy.

Referring now also to FIGS. 4–6, the privacy chamber 2 preferably includes a portable toilet 32 which is positioned inside of the openable enclosure 10. When an individual wishes to use the privacy chamber 2, he or she can remove the parts thereof enclosed within the openable enclosure 10 as is shown in FIG. 4 and assemble the partial enclosure 30 in a simple assembly process. In addition to the openable enclosure 10, the assembled privacy chamber 2 of the present invention includes a vertically extending sectional support member 14, a mechanism for anchoring 16 the sectional member 14 inside of the openable enclosure 10, an upper support frame 20 which rests upon a hook 24 attached to an upper segment 15' of the support member 14, and a flexible sheet 22 which is attached to the upper support frame 20 such that the flexible sheet 22 hangs from the upper support frame 20 thereby providing for the partial enclosure 30 which affords privacy to an individual within the partial enclosure 30. An upper support mechanism 18 is provided for supporting the upper support frame 20 such that the upper support 20 can support the flexible sheet 22 when the sheet 22 is attached to the upper support frame 20.

The sectional support member 14 includes a plurality of elongated cooperating segments 15 which are preferably rigid hollow tubes having male and female ends 15*a* and 15*b*. In the most preferred embodiments of the present invention, there are two such segments, an upper and a lower segment 15' and 15''. The male end 15*b*' of the upper segment 15' is received in the female end 15*a*'' of the lower segment 15'', and the male end 15*b*'' of the lower segment 15'' is received in a segment receiving opening 17 in the anchoring mechanism 16 which is attached to the inside of the openable enclosure 10. Attached to an upper portion of the upper segments 15', there is a hook 24 which supports the upper support frame 20 when the privacy chamber 2 is assembled to provide the partial enclosure 30 of the present invention. The upper support mechanism 18 of the preferred embodiment includes the hook 24 and two support stays 26, preferably comprising a single nylon cord 27 having loops 28 at its two ends which are anchored in the upper support frame 20 by screws 29 as shown in FIG. 5. The nylon cord 27 is passed through a capring 34 which is attached to an insertable cap 36. The segments 15' and 15'' are hollow tubes in which the insertable cap 36 can be received when the partial enclosure 30 is fully assembled. The insertable cap 36 is received in the female end 15*a*' of the upper segment 15'.

The preferred embodiment of the privacy chamber 2 of the present invention includes a lower support frame 38. The flexible sheet 22 is attachable to the lower support frame. Preferably, the flexible sheet 22 is folded over and sewn together leaving seamlines 25*a* and 25*b* at both the top 23*a* and the bottom 23*b* of the flexible sheet 22, thereby enclosing the respective upper and lower support frames 20 and 38. It will be appreciated that any other well known mechanisms for holding the folded flexible sheet 22 together, such as for example glue, staples, or the like, will also be effective to enclose the respective support frames 20 and 38. The lower support frame 38 is attached to the inside of the openable enclosure 10 by four screws 29'. The screws 29' pass through the support frame 38 and the flexible sheet 22 and into an inside wall 11 of the openable enclosure 10. The support frames 20 and 38 are preferably made with hollow tube polyvinyl chloride (PVC) pipe construction, most preferably using half inch PVC pipes and half inch PVC elbow connectors which are fastened to the adjoining pipes using well known fastening techniques.

The openable top 12 of the present invention is preferably hinged to the openable enclosure 10. In the embodiment shown in FIG. 5, the top 12 is attached to the openable enclosure 10 by three hinges 48. It will be appreciated, however, that the openable top 12 need not be attached, but may simply be removable. Other equivalent mechanisms for hinging the top 12 to the openable enclosure 10 may also be used such as other well known hinge mechanisms including straps and the like which are fixed to the top 12 and to the enclosure 10.

At one end of the openable enclosure 10 shown in FIGS. 4–6, there is a collapsible front wall 40 which is attached to the openable enclosure with hinges 42, a latch and catch mechanism 44 including a latch 45 on the backside 46 of the collapsible front wall 40 and a catch 47 attached to the inside of the openable enclosure 10. When the collapsible wall 40 is raised, the latch 45 is inserted within the catch 47 to hold the collapsible front wall 40 in place as shown in FIG. 4. When the latch 45 is disengaged from the catch 47 and the collapsible front wall 40 is lowered, it provides a convenience for individuals entering the assembled partial enclosure 30 of the privacy chamber 2 because collapsing the collapsible front wall 40 effectively lowers the threshold over which one must step to step into the openable enclosure 10 which forms a base for the partial enclosure 30. The lower support frame 38 is preferably attached to the inside of the openable enclosure 10 at a position below the hinges 42 which attach the collapsible front wall 40 to the openable enclosure 10. When the partial enclosure 30 is assembled, the flexible sheet 22 extends around each of the support frames 20 and 38 providing an opening 31 between the ends **22*a* and 22*b* of the sheet 22, preferably opposite the support member 14. The sheet 22 can slide along the support frames 20 and 38 to the degree to which they are not limited by the screws 29 and 29'**.

When the parts of the partial enclosure 30 are disassembled and enclosed in the openable enclosure 10 as shown in FIG. 4, and an individual wishes to use the privacy chamber 2, it may be assembled very rapidly. Preferably, the privacy chamber 2 may be assembled in less than one minute, more preferably in less than about 30 seconds. As individuals become more familiar with the privacy chamber 2 of the present invention, it will become easy to assemble in less than about 20 seconds, preferably less than about 15 seconds. Furthermore, the privacy chamber 2 of the present invention may be easily assembled by a single individual of a moderate height.

To assemble the privacy chamber shown in FIGS. 4–6, the openable top 12 is first opened. Although not necessary in all cases, the collapsible front wall 40 is preferably unlatched and lowered to enable one to easily step into the openable enclosure 10. Second, the upper and lower segments 15' and 15'' are removed from the openable enclosure 10 and assembled and anchored in the openable enclosure 10. This is very straightforward and requires little to no instruction. The male end **15*b*'' of the lower segment 15'' is inserted into the segment receiving opening 17 of the anchoring mechanism 16 which is attached to the inside of the openable enclosure 10. The male end 15*b*' of the upper segment 15' is then inserted into the female end 15*a*'' of the lower segment 15''. Alternatively, the upper and lower segments 15' and 15'' are assembled first, and then the male end 15*b*'' of the lower segment 15'', now a portion of the assembled support member 14, is inserted into the receiving opening 17 of the anchoring mechanism 16. Preferably, the support member will then extend vertically from the openable enclosure 10. All that remains to be done to assemble the privacy chamber 2 is to lift the upper support frame 20, place it on the hook 24 attached to the upper end 19 of the upper segment 15' and then insert the insertable cap 36 into the female end 15*a*' of the upper segment 15'. The privacy chamber 2 is then completely assembled and the individual may carry on with whatever else he or she wishes to accomplish inside the partial enclosure 30. If, when one lifts the upper support frame 20 out of the openable enclosure 10, one were to step into the openable enclosure 10 through the opening between ends 22*a* and 22*b* of the flexible sheet 22, which will be the opening 31 in the partial enclosure 30 when it is assembled, then one will be inside the partial enclosure 30 when it becomes assembled, thereby eliminating the need to enter the partial enclosure 30** after it is assembled.

To disassemble the privacy chamber 2, the insertable cap 36 is removed from the support member 14 and the upper support frame 20 and the attached flexible sheet 22 are lifted off the hook 24 and lowered into the openable enclosure 10. The flexible sheet 22 preferably folds into the openable enclosure in an accordion like manner. The upper and lower segments 15' and 15'' can then be disassembled and placed into the openable enclosure 10. The collapsible front wall 40 maY then be raised and latched and the openable top 12 maY be closed.

The alternate embodiment shown in FIG. 3 differs from the preferred embodiment shown in FIGS. 4–6 in several ways including but not limited to the following. The opening 31' in the partial enclosure 30' is not located opposite the support member 14, but rather as shown in phantom in FIG. 3. Also, the collapsible front wall 40' includes only a portion of a side of the enclosure 10'. As with the preferred embodiment, however, the alternate embodiment may or may not include a portable toilet 32 inside of the openable enclosure 10'.

It is to be understood, however, that even though these numerous characteristics and advantages of the invention have been set forth in the foregoing description, together with details of the structure and function of the invention, the disclosure is illustrative only, and changes may be made in detail, especially in matters of shape, size and arrangement of the parts within the principle of the invention to the full extent indicated by the broad general meaning of the terms in which the appendent claims are expressed.

What is claimed is:

1. A privacy chamber, comprising:

(a) an openable enclosure having an openable top;

(b) a sectional support member including a plurality of elongated cooperating segments, wherein the cooperating segments can cooperate to form the sectional support member, said cooperating segments having male and female ends such that the cooperating segments can be assembled by inserting one into another in an end-to-end relationship;

(c) means for anchoring said sectional support member inside of said openable enclosure, said anchoring means cooperating with said cooperating segments such that the cooperating segments cooperate with said anchoring means such that the support member can extend vertically from the openable enclosure when said enclosure is open;

(d) an upper support frame attachable to an upper portion of said support member;

(e) a flexible sheet attachable to the upper support frame such that the flexible sheet can hang from the upper support frame thereby providing a partial enclosure such that one can obtain a measure of privacy, said flexible sheet being a curtain which can be drawn substantially around an individual to form said partial enclosure such that the image of the individual inside is not clearly visible to a person outside;

(f) a lower support frame, said flexible sheet being attached to said lower support frame, said lower support frame being attached to inside walls of said openable enclosure; and (g) upper support means for supporting said upper support frame such that said upper support frame can support the flexible sheet when the sheet is attached to the upper support frame.

2. The privacy chamber of claim 1, said openable enclosure providing a place to sit when said openable top is in place on top of said openable enclosure and said openable enclosure is closed, said top being able to support an individual sitting on said top so that said enclosure can be used to provide seating for individuals.

3. The privacy chamber of claim 1, said anchoring means providing an opening to receive a male end of one of said cooperating segments.

4. The privacy chamber of claim 1, the upper support frame including a rectangular frame.

5. The privacy chamber of claim 1, said upper support means including a hook attached to said upper segment of said support member, said hook providing support for said upper support frame when said upper support frame rests upon the hook.

6. The privacy chamber of claim 5, said upper support means including a plurality of support stays, attachable to the support member in a position higher than the position where the upper support frame rests upon the hook and attachable to the upper support frame in the position removed from a position where the upper support frame rests upon the hook.

7. The privacy chamber of claim 1, said openable enclosure including a collapsible front wall including hinge means which allow said front wall to fold down to facilitate entry into said openable enclosure when the top is removed and the openable enclosure is open.

8. The privacy chamber of claim 1, the openable enclosure being incorporated into a deck of a boat.

9. The privacy chamber of claim 1, further comprising a substantially self-contained portable toilet located inside of said openable enclosure.

10. The privacy chamber of claim 9, the openable enclosure having a sufficient internal space to enclose said portable toilet and all of the elements of said privacy chamber when disassembled and placed in the openable enclosure and the openable enclosure is closed.

11. The privacy chamber of claim 1, said lower support frame having a rectangular shape which fits inside said openable enclosure and along inside walls of said openable enclosure.

12. The privacy chamber of claim 1, the openable top being hinged to the openable enclosure.

13. The privacy chamber of claim 1, the top being padded so as to provide a padded seat for sitting when the top is on top of the openable enclosure and the enclosure is closed.

14. The privacy chamber of claim 1, the openable enclosure being portable such that it may be moved from place to place.

15. A privacy chamber, comprising:

(a) an openable enclosure having an openable top, said openable enclosure being portable such that it may be moved from place to place said openable enclosure providing a place to sit when said openable top is in place on top of said openable enclosure and said openable enclosure is closed, said top being able to support an individual sitting on said top so that said enclosure can be used to provide seating for individuals;

(b) a sectional support member including a plurality of elongated cooperating segments, wherein the cooperating segments can be assembled together to form the sectional support member, said cooperating segments having male and female ends such that the cooperating segments can be assembled by inserting one into another in an end-to-end relationship;

(c) means for anchoring said sectional support member inside of said openable enclosure, said anchoring means cooperating with said cooperating segments such that the cooperating segments can be assembled with said anchoring means such that the assembled support member can extend vertically from the openable enclosure when said enclosure is open;

(d) an upper support frame attachable to an upper portion of said support member;

(e) a flexible sheet attachable to the upper support frame such that the flexible sheet can hang from the upper support frame, thereby providing a partial enclosure such that one can obtain a measure of privacy;

(f) upper support means for supporting said upper support frame such that said upper support frame can support the flexible sheet when the sheet is attached to the upper support frame; and (g) a lower support frame, said flexible sheet being attached to said lower support frame, said lower support frame being attached to inside walls of said openable enclosure.

16. The privacy chamber of claim 15 further comprising a substantially self-contained portable toilet located inside of said openable enclosure.

17. A privacy chamber, comprising:

(a) an openable enclosure having an openable top, said openable enclosure being incorporated into a deck of a boat;

(b) a sectional support member including a plurality of elongated cooperating segments, wherein the cooperating segments can be assembled together to form the sectional support member, said cooperating segments having male and female ends such that cooperating segments can be assembled by inserting one into another in an end-to-end relationship;

(c) means for anchoring said sectional support member inside of said openable enclosure, said anchoring means cooperating with said cooperating segments such that the cooperating segments can be assembled with said anchoring means such that the assembled support member can extend vertically from the openable enclosure when said enclosure is open;

(d) an upper support frame attachable to an upper portion of said support member;

(e) a flexible sheet attachable to the upper support frame such that the flexible sheet can hang from the upper support frame, thereby providing a partial enclosure such that one can obtain a measure of privacy;

(f) upper support means for supporting said upper support frame such that said upper support frame can support the flexible sheet when the sheet is attached to the upper support frame; and (g) a lower support frame, said flexible sheet being attached to said lower support frame, said lower support frame being attached to inside walls of said openable enclosure.

18. The privacy chamber of claim 17 further comprising a substantially self-contained portable toilet located inside of said openable enclosure.

* * * * *